US005148227A

United States Patent [19]

Senba et al.

[11] Patent Number: 5,148,227

[45] Date of Patent: Sep. 15, 1992

[54] CLEANING ROLLER AND CLEANING APPARATUS

[75] Inventors: Hisaaki Senba; Makoto Jinzai, both of Yokohama, Japan

[73] Assignee: Canon Kabushiki Kaisha, Tokyo, Japan

[21] Appl. No.: 837,603

[22] Filed: Feb. 21, 1992

Related U.S. Application Data

[63] Continuation of Ser. No. 551,307, Jul. 12, 1990, abandoned.

[30] Foreign Application Priority Data

Jul. 13, 1989 [JP] Japan ..... 1-179120

[51] Int. Cl.[5] ..... G03G 21/00

[52] U.S. Cl. ..... 355/296

[58] Field of Search ..... 355/296, 297, 299, 301, 355/302, 303

[56] References Cited

U.S. PATENT DOCUMENTS 4,181,425 1/1980 Higaya et al. .
4,253,761 3/1981 Takizawa et al. ..... 355/302
4,530,596 7/1985 Kawamoto et al. ..... 355/303
4,674,865 6/1987 Tada et al. ..... 355/297 X
4,739,370 4/1988 Yoshida et al. .
4,823,153 4/1989 Coburn ..... 355/296 X
4,959,688 9/1990 Koitabashi ..... 355/219
4,998,143 3/1991 Kumasaka et al. ..... 355/271

*Primary Examiner*—A. T. Grimley
*Assistant Examiner*—Sandra L. Brase
*Attorney, Agent, or Firm*—Fitzpatrick, Cella, Harper & Scinto

[57] ABSTRACT

The present invention provides a cleaning apparatus comprising a cleaning rotary member arranged to be pressed against a movable image bearing member, for removing residual toner on the image bearing member. Cleaning rotary member has a first elastic layer as an outer layer, and a second elastic layer disposed inside of the first elastic layer. Second elastic layer has a volume resistance smaller than that of the first elastic layer. The present invention further provides a cleaning roller comprising a core metal, a conductive layer disposed on the core metal and an insulation layer disposed on the conductive layer.

31 Claims, 3 Drawing Sheets

FIG. 1
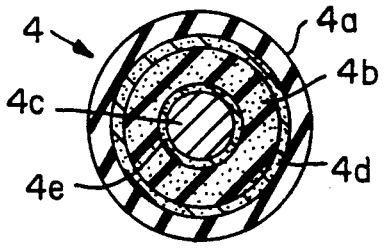
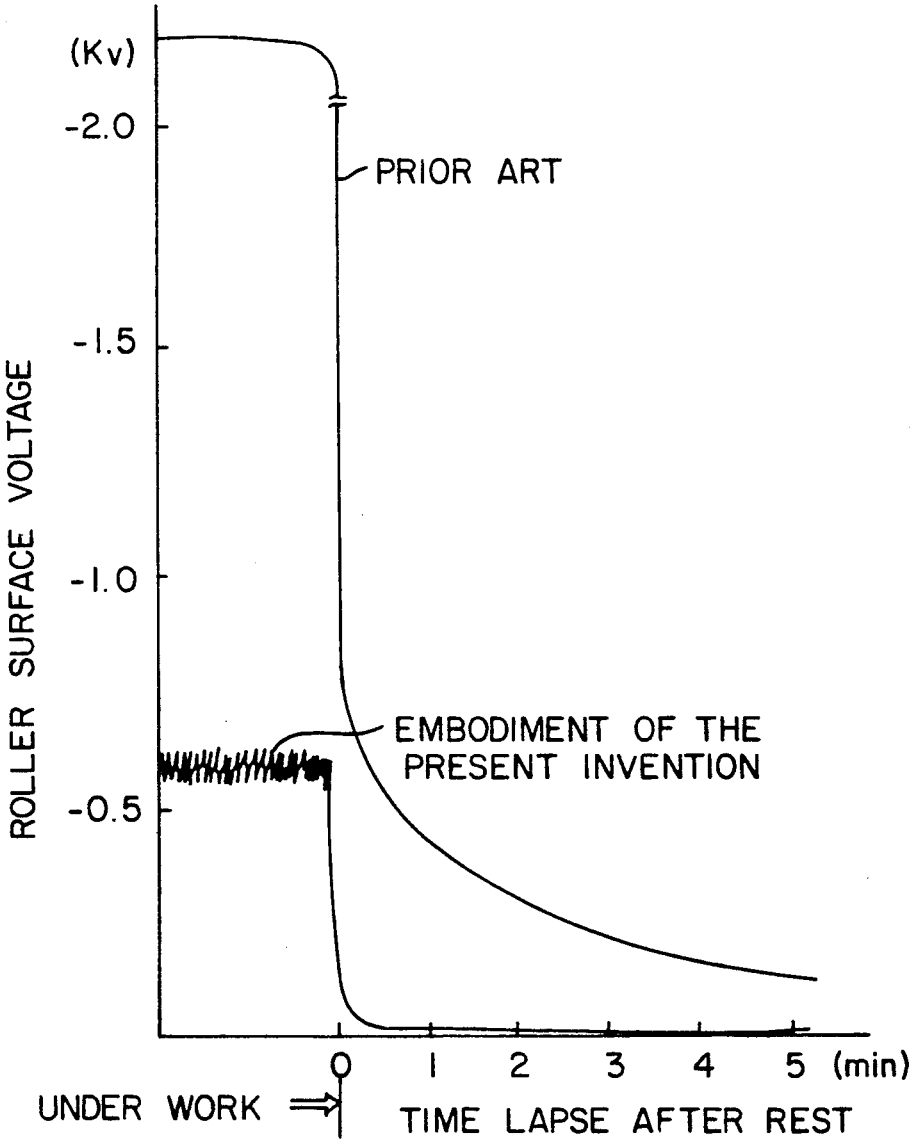
FIG. 2

CLEANING ROLLER AND CLEANING APPARATUS

This application is a continuation of application Ser. No. 07/551,307 filed Jul. 12, 1990 now abandoned.

BACKGROUND OF THE INVENTION

1. Field of the Invention

The present invention relates to a cleaning roller and cleaning apparatus used with an image forming system utilizing an electrostatic process, such as an electrostatic copying machine, an electrostatic printer or the like.

2. Related Background Art

In conventional image forming systems wherein a process for transferring a toner image electrostatically formed on an image bearing member onto a transfer material as a recording sheet is repeated, in order to obtain a good image, whenever each transferring operation is finished, it is indispensable to adequately remove residual toner not transferred onto the transfer material and remaining on the image bearing member, paper powder generated from the transfer material, eductions such as rosin and/or talc, and foreign matter adhered to the image bearing member such as corona product generated due to the presence of high pressure members in the system.

As the cleaning means for removing such foreign matters and the like, in the past, a cleaning apparatus including a cleaning blade made of elastic material such as rubber for removing mainly the residual toner, and an elastic cleaning roller made of urethane rubber or the like in sliding contact with the image bearing member for removing the above-mentioned foreign matter and the like has been proposed.

FIG. 6 shows a typical example of such conventional cleaning apparatus 2 which is arranged in parallel with and in the vicinity of an image bearing member 1 extending in a direction perpendicular to a plane of FIG. 6 and rotatable in a direction shown by the arrow A. A cleaning blade 3 attached at its one end of the cleaning apparatus has the other free end pressed against a surface of the image bearing member 1 and serves to remove residual toner remaining on the image bearing member (which was not transferred onto a transfer material in a transfer station (not shown)).

Incidentally, around the image bearing member 1, image forming means such as a charger, a developing device and the like (all not shown) are arranged. Further, at an upstream side of the cleaning blade 3 with respect to the rotating direction of the image bearing member 1, an elastic cleaning roller 4' is arranged and is pressed against the image bearing member. In operation, the cleaning roller is rotated at a speed of 50%-30% with respect to the rotation speed of the image bearing member to frictionally slide on the latter.

The cleaning roller 4' comprises a core metal 4'c, an outer layer 4'a made of insulation material such as silicone rubber, urethane rubber or the like, and inner layer 4'b made of sponge or elastic insulation material which is the same kind of the material of the outer layer but has lower hardness, so that the pressing force against the image bearing member is appropriately regulated or adjusted. A scraper 5 is urged against the cleaning roller 4' to form a thin toner layer on the outer layer 4a' thereof. In this way, by frictionally sliding the cleaning roller 4' on the image bearing member 1 and by appropriately selecting the materials of the cleaning roller 4' and of the scraper 5 to maintain the cleaning roller at high potential due to the friction between the elements 4' and 5, the residual toner is electrostatically removed from the image bearing member. In order to remove the toner as mentioned above, it is necessary to generate the electric charge on the cleaning roller; and to do so, it is necessary to form the outer surface of the cleaning roller with insulation material having high volume resistance. With this arrangement, the toner and other foreign matter can be removed effectively. However, when the cleaning roller is maintained at a high voltage as mentioned above, if the printing operation for obtaining particularly an image having an intermediate tone is performed, by starting the image forming system again after several tens of minutes has elapsed from when the system was stopped, there arose a problem that a low density area or a white blank area (impression of roller) was generated at a position of the image corresponding to a position where the cleaning roller was engaged by the image bearing member during stoppage of the system.

For example, if an OPC sheet having a negative cleaning feature was used as a photosensitive member and and the cleaning roller having outer and inner layers made of urethane rubber as insulation material was used, after 500 transfer sheets of A4 size have continuously been handled and then the system was stopped for 20 minutes, when the system was operated again to obtain an image having a density of 0.3-0.7, it was found that the white blank of 1-6 mm was generated at a position of the image corresponding to a position where the cleaning roller was contacted with the image bearing member (normally, forming a nip of 2-4 mm).

The reason why the white blank is generated is not always clear, but is considered as follows. That is to say, the negative frictional charge generated during the operation of the cleaning roller maintains the surface of the roller at relatively high voltage after the roller is stopped, with the result that the photosensitive layer of the image bearing member is also charged at the similar voltage. Consequently, when the positive charge is added from the base of the image bearing member, the trapping condition is generated, so that, when the system is operated again after it has been stopped for a certain time, the voltage of the trapped portion cannot be adequately increased. After all, by charging the cleaning roller, the cleaning ability is improved, but the quality of the image is worsened due to the generation of the white blank.

SUMMARY OF THE INVENTION

An object of the present invention is to provide a cleaning apparatus which can prevent degradation of an image bearing member when toner is removed by the charge generated on a surface of a cleaning rotary member.

Another object of the present invention is to provide a cleaning roller which can clean an image bearing member without formation of an impression of the roller on the image bearing member.

A further object of the present invention is to provide a cleaning apparatus which can prevent degradation of an image bearing member when residual foreign matter are removed by a cleaning rotary member made of a elastic material.

The other objects of the present invention will be apparent from the following description.

BRIEF DESCRIPTION OF THE DRAWINGS

FIG. 1 is a sectional view of a cleaning roller applied to a cleaning apparatus according to a preferred embodiment of the present invention;

FIG. 2 is a graph showing the relationship between roller surface voltage and time regarding the cleaning roller shown in FIG. 1 and a conventional cleaning roller during the operation and rest thereof;

DETAILED DESCRIPTION OF THE PREFERRED EMBODIMENT

Figure 3:
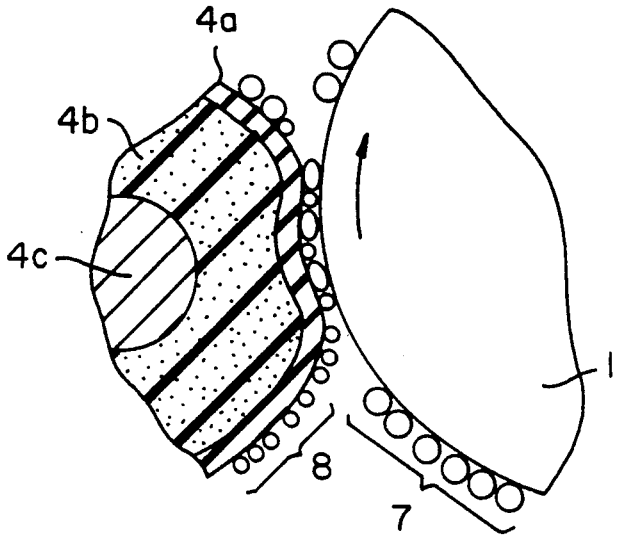
FIG. 3 is an enlarged sectional view showing the relation between toner and charge at a nip between a photosensitive member and the cleaning roller of FIG. 1.

The present invention will now be explained in connection with embodiments thereof with reference to the accompanying drawings.

FIG. 1 shows a cleaning roller adapted to a cleaning apparatus according to a preferred embodiment of the present invention as a cross-sectional view.

As shown in FIG. 1, the cleaning roller 4 comprises a core metal 4*c*, an inner layer 4*b* and an outer layer 4*a*. The inner layer 4*b* is made of urethane sponge impregnated with conductive filler such as carbon particles and has a specific resistance of $10^6$ Ωcm, and the outer layer 4*a* is made of urethane rubber layer as insulation material and has a specific resistance of $10^{12}$ Ωcm. In this way, since the inner and outer layers of the cleaning roller 4 is made of elastic material, the damage of a photosensitive member can be prevented even when the roller 4 is pressed against the photosensitive member. Incidentally, the hardness of the outer layer is greater than that of the inner layer. Further, the inner layer 4*b* is firmly bonded to the core 4*c* by an adhesive 4*e*, and the outer layer 4*a* is also firmly bonded to the inner layer 4*b* by an adhesive 4*d*. These adhesives each has a specific resistance of about $10^3$ Ωcm.

When transfer materials (recording sheets) are handled in an image forming system having a cleaning apparatus including such cleaning roller 4, the following results were obtained.

(1) Continuous handling of 500 sheets of A4 size and rest of system for 20 minutes In this case, an impression of the roller was not generated on each recording sheet.

(2) Intermittent handling of a sheet of A4 size

In this case, phenomena such as disorder of a latent image, filming, deterioration of cleaning ability were not generated.

That is to say, it was possible to prevent the impression of the roller (white blank) while maintaining the cleaning ability.

The fact that such result could be obtained will be examined or explained on the basis of the change in a surface voltage of the cleaning roller with reference to a graph shown in FIG. 2 wherein the abscissa indicates a rest time after the sheets have continuously been handled and the ordinate indicates a roller surface voltage.

In case of a conventional cleaning roller, the surface voltage of a cleaning roller reaches −2 Kv or more, and is abruptly decreased and then is gradually decreased as the time is elapsed. Even after five minutes, the surface voltage is still maintained at minus hundred and few tens of volts. This residual voltage is considered to create the above-mentioned low density area or white blank area.

On the other hand, in the above-mentioned cleaning roller according to the embodiment of the present invention, the surface of the roller is maintained at a low voltage during the operation thereof, and is decreased to a very low value after the rest of the roller, thus preventing the generation of the impression of the roller, i.e., white blank.

The reason why the surface voltage is maintained at the low value even during the operation of the roller is that the surface voltage accumulated by the friction between the photosensitive member and the scraper is decreased, without change in the voltage due to the friction, since the inner layer of the roller has the low resistance and the insulation layer is thinned to increase electrostatic capacity of the outer layer of the roller. In this way, since the surface voltage of the roller can be maintained at the low value (in this case, nagative voltage), it is possible to prevent the impression of roller on the photosensitive member (OPC photosensitive member) having the negative charging feature due to the surface charge of the roller, thus permitting the formation of a good image.

Next, the relationship between the charge on the cleaning roller and the residual toner on the surface of the photosensitive member will be explained with reference to FIG. 3.

FIG. 3 is an enlarged schematic view showing the nip between the cleaning roller 4 and the photosensitive member 1. In the illustrated embodiment, since the electrostatic force acts between the toner 7 and the charge 8, and the toner is positively shifted onto the roller to form a toner layer due to the presence of the charge on the roller, the cleaning ability is not worsened, unlike the case where the generation of the impression of roller is prevented by removing the charge from the roller surface to decrease the surface voltage.

In the illustrated embodiment, while each layer other than the outer layer was constituted by the low resistance layer, only the sponge layer may have a low resistance. In this case, since the electrostatic capacity can be increased, the same advantage can be achieved.

According to the examined result regarding each layer of the cleaning roller, since an outermost layer must hold the charge, it may be constituted by an insulation layer having a resistance of $10^{11}$ Ωcm or more; otherwise, the cleaning ability will be worsened due to the increase of the leak of the charge.

The low resistance layers must be constituted by semi-conductive or conductive layer having $10^8$ Ωcm or less, for the purpose that the electrostatic capacity is increased to reduce the surface voltage of the cleaning roller; otherwise, the impression of roller will occur. Further, in the aforementioned embodiment, if the core metal is either grounded or kept in a floating condition, the same advantage was obtained.

Next, other embodiments of the invention will be explained.

Figure 4:
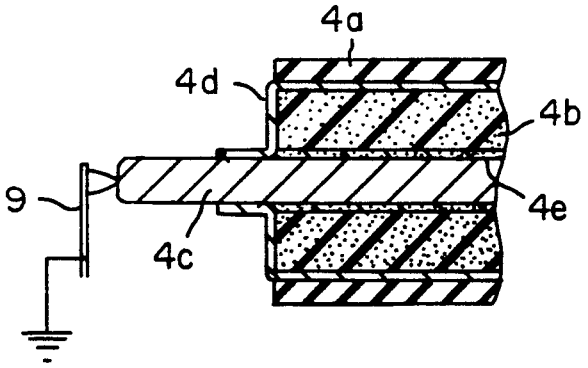
FIG. 4 is a longitudinal sectional view of a cleaning roller according to another embodiment of the present invention.

FIG. 4 shows a portion of a cleaning roller according to another embodiment of the present invention as a sectional view. This cleaning roller is also applicable to a cleaning apparatus, as similar to the previous embodiment.

An outer layer 4a and an inner layer 4b of the cleaning roller of FIG. 4 have the same construction as those of the previous embodiment; however, in this embodiment, the adhesive layer 4d extends along an end of the inner layer 4b to reach a core metal 4c, and the inner layer is adjusted to have a specific resistance of $10^8$ Ωcm or less.

When the resistance value of such inner layer is adjusted by impregnating the conductive filler, it is feared that the strength and/or hardness of the cleaning roller is greatly changed due to the impregnation of such filler to damage the photosentive member. However, with the arrangement as this embodiment, such fear can be avoided even if the elastic layers of the roller is the same as those of the conventional cleaning roller. Further, since the adhesive leyer 4d is grounded through the core metal, the electrostatic capacity of the roller is increased. Accordingly, similar to the previous embodiment, since the surface voltage of the cleaning roller can be maintained at a low value, it is possible to obtain the good cleaning ability, to prevent the impression of roller on the photosensitive member, and to achieve the stable formation of the image.

Figure 5:
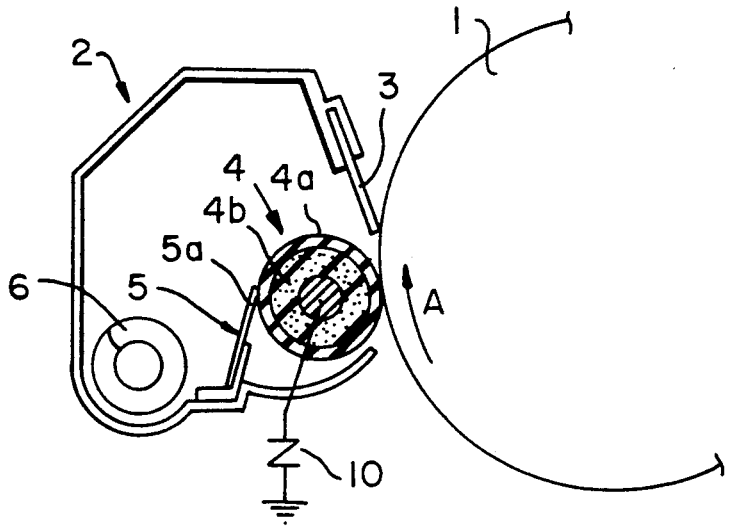
FIG. 5 is a sectional view of a cleaning apparatus according to a further embodiment of the present invention.
Figure 6:
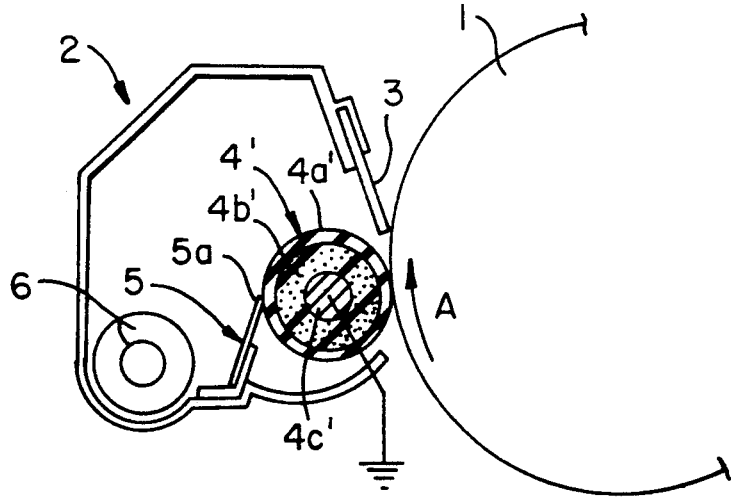
FIG. 6 is a sectional view of a conventional cleaning apparatus.

FIG. 5 shows a cleaning roller applied to a cleaning apparatus according to a further embodiment of the present invention.

If the diameter of each toner particle is small as 6–8 μm and the tribo (friction charge) is large, it is desirable to increase the electrostatic attracting force of the roller acting on the toner, and, thus, it is preferable to slightly increase the surface charge of the roller during the operation thereof, for example, to have a value of about −500 ~ −1000 V for the positive (plus) toner.

This embodiment meets the above requirements, and uses the cleaning roller having the layers (other than the outer layer 4a) of low resistance. A metallic core 4c is grounded through a constant voltage element such as a varister or a high resistive element, and a bias power source controlled at a constant voltage. For example, if the surface voltage of the roller is maintained at a value of about −5000 V during the operation thereof, the varister having the rated value of about 400 V may be used, in consideration of the voltage carried by the outer layer 4a.

When the plus toner having an average particle diameter of 7 μm was used and the roller having the inner layer of the same construction as that of the previous embodiment was used and the varister having the rated value of 430 V was used, a slight impression of roller was generated (in comparison with the case of mere grounding construction), but such impression was not affected badly in the practical use; whereas, more stable results regarding the formation of the toner layer and the maintenance of the cleaning ability.

As mentioned above, while the present invention was explained with respect to specific embodiments thereof, the present invention is not limited to such embodiments, and various modifications and alterations can be effected within the scope of the present invention.

What is claimed is:

1. A cleaning apparatus for cleaning a movable image bearing member, comprising:

a rotary cleaning member arranged to be pressed against said image bearing member for removing residual toner from said image bearing member, wherein said rotary cleaning member comprises a surface insulating layer, a core member, and a conductive layer arranged between said surface insulating layer and said core member, and wherein said conductive layer is directly grounded to dissipate electrical charge from said insulating layer.

2. A cleaning apparatus according to claim 1, wherein said surface insulating layer is made of urethane.

3. A cleaning apparatus according to claim 1, wherein said core member is made of metal, and said conductive layer is grounded via said core member.

4. A cleaning apparatus according to claim 1, wherein said conductive layer is a rubber layer provided on said core member.

5. A cleaning apparatus according to claim 4, wherein said surface insulting layer is provided on said conductive layer.

6. A cleaning apparatus according to claim 4, wherein said conductive layer has a hardness lower than that of said surface insulating layer.

7. A cleaning apparatus according to claim 1, wherein volume resistance value of said surface insulating layer is greater than $10^{11}$ Ωcm, while volume resistance of said conductive layer is less than $10^8$ Ωcm.

8. A cleaning apparatus according to claim 1, wherein said rotary cleaning member removes the residual toner form said image bearing member by scrubbing.

9. A cleaning apparatus according to claim 1, further comprising a sliding member frictionally sliding on said image bearing member.

10. A cleaning apparatus according to claim 1, further comprising a cleaning blade disposed at a downstream side of said rotary cleaning member with respect to a moving direction of said image bearing member.

11. A cleaning apparatus according to claim 1, further comprising an adhesive layer and said surface insulating layer is disposed on said conductive layer by being adhered thereto with said adhesive layer.

12. A cleaning apparatus according to claim 11, wherein said conductive core member is grounded, and said adhesive layer is disposed on a surface of said core member.

13. A cleaning apparatus according to claim 11, wherein said surface insulating layer is made of urethane.

14. A cleaning apparatus according to claim 1, wherein said insulating layer is frictionally charged such that it has polarity opposite to that of the toner.

15. A cleaning apparatus according to claim 14, wherein said image bearing member comprises an organic photoconductive photosensitive member having a negative charging feature, while said rotary cleaning member is charged with negative polarity.

16. A cleaning apparatus according to claim 1, wherein said conductive layer is grounded via a passive constant voltage element.

17. A cleaning apparatus for cleaning a movable image bearing member, comprising:

a rotary cleaning member arranged to be pressed against said image bearing member for removing residual toner from said image bearing member, characterized in that said rotary cleaning member has a surface insulating layer, core member and a rubber layer containing a conductive material and disposed between said surface insulating layer and said core member, wherein said rubber layer has a sponge-like construction, and wherein said rubber layer is grounded to dissipate electrical charge from said insulating layer.

18. A cleaning apparatus according to claim 17, wherein said surface insulating layer is made of urethane.

19. A cleaning apparatus according to claim 17, wherein volume resistance of said surface insulating layer is selected over $10^{11}$ Ωcm, while volume resistance of said rubber layer is selected below $10^{8}$ Ωcm.

20. A cleaning apparatus according to claim 17, wherein said surface insulating layer is made of a rubber which has hardness higher than that of said rubber layer.

21. A cleaning apparatus according to claim 17, wherein said rotary cleaning member removes the residual toner by being scrubbed with said image bearing member.

22. A cleaning apparatus according to claim 17, further comprising a frictional sliding member frictionally sliding on said image bearing member.

23. A cleaning apparatus according to claim 17, further comprising a cleaning blade disposed at a downstream side of said rotary cleaning member with respect to a moving direction of said image bearing member.

24. A cleaning apparatus according to claim 17, wherein said rubber layer is grounded.

25. A cleaning apparatus according to claim 17, wherein said rubber layer is grounded via a constant voltage element.

26. A cleaning apparatus according to claim 17, wherein said insulating layer is frictionally charged with polarity opposed to that of the toner.

27. A cleaning apparatus according to claim 17, wherein said image bearing member comprises an organic photoconductive photosensitive member having a negative charging feature, while said rotary cleaning member is charged with negative polarity.

28. A rotary cleaning member, comprising:

a core member;

a surface insulating layer;

a rubber layer containing a conductive material and disposed between said core member and said surface insulating layer, wherein said rubber layer has a sponge-like construction, and wherein said rubber layer is grounded to dissipate electrical charge from said insulating layer.

29. A rotary cleaning member according to claim 28, wherein said surface insulating layer is made of urethane.

30. A rotary cleaning member according to claim 28, wherein volume resistance of said surface insulating layer is selected over $10^{11}$Ωcm, while volume resistance of said rubber layer is selected below $10^{8}$Ωcm.

31. A rotary cleaning member according to claim 28, wherein said surface insulating layer is made of a rubber which has hardness higher than that of said rubber layer.

* * * * *